US011746405B2

(12) United States Patent
Higuchi et al.

(10) Patent No.: US 11,746,405 B2
(45) Date of Patent: Sep. 5, 2023

(54) THERMAL SPRAYED COATING FOR SLIDING MEMBER, AND SLIDING DEVICE PROVIDED WITH THERMAL SPRAYED COATING FOR SLIDING MEMBER

(71) Applicant: NISSAN MOTOR CO., LTD., Yokohama (JP)

(72) Inventors: Tsuyoshi Higuchi, Kanagawa (JP); Hayato Hirayama, Kanagawa (JP); Akinobu Itou, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 17/289,869

(22) PCT Filed: Nov. 2, 2018

(86) PCT No.: PCT/IB2018/001397
§ 371 (c)(1),
(2) Date: Apr. 29, 2021

(87) PCT Pub. No.: WO2020/089666
PCT Pub. Date: May 7, 2020

(65) Prior Publication Data

US 2021/0404044 A1 Dec. 30, 2021

(51) Int. Cl.

| | |
|---|---|
| ***C23C 4/073*** | (2016.01) |
| ***C23C 4/16*** | (2016.01) |
| ***F02F 1/00*** | (2006.01) |
| ***F02F 3/00*** | (2006.01) |
| ***F02F 3/10*** | (2006.01) |

(52) U.S. Cl.
CPC ..... *C23C 4/073* (2016.01); *C23C 4/16* (2013.01); *F02F 1/00* (2013.01); *F02F 3/0084* (2013.01); *F02F 3/10* (2013.01)

(58) Field of Classification Search
CPC .. C23C 4/073; C23C 4/16; C23C 4/02; C23C 4/06; C23C 4/131; C23C 4/137; C23C 4/12; C23C 4/08; F02F 1/00; F02F 3/0084; F02F 3/10
USPC ..... 123/193.6
See application file for complete search history.

(56) References Cited

U.S. PATENT DOCUMENTS

| | | | | |
|---|---|---|---|---|
| 4,330,575 | A * | 5/1982 | Litchfield | C23C 4/06 427/217 |
| 4,411,936 | A | 10/1983 | Schrewelius | |
| 4,822,415 | A | 4/1989 | Dorfman et al. | |
| 9,828,934 | B2 | 11/2017 | Hamada et al. | |
| 2005/0227078 | A1* | 10/2005 | Power | F04D 29/324 428/408 |
| 2008/0213115 | A1* | 9/2008 | Hilger | F04B 25/00 417/569 |
| 2009/0075112 | A1* | 3/2009 | Kulkarni | C23C 4/06 428/457 |
| 2012/0020828 | A1* | 1/2012 | Suhonen | C23C 4/06 420/431 |
| 2013/0089682 | A1 | 4/2013 | Izquierdo et al. | |
| 2014/0225330 | A1* | 8/2014 | Saito | C23C 4/06 277/442 |
| 2015/0152529 | A1* | 6/2015 | Otobe | C23C 4/06 428/656 |
| 2016/0177863 | A1 | 6/2016 | Hamada et al. | |
| 2016/0230697 | A1 | 8/2016 | Shinohara et al. | |
| 2017/0218954 | A1* | 8/2017 | Nishimura | F04C 18/3564 |
| 2019/0136792 | A1* | 5/2019 | Cifali | F02F 3/003 |

FOREIGN PATENT DOCUMENTS

| | | | |
|---|---|---|---|
| CN | 1948544 | A * | 4/2007 |
| DE | 10 2015 013 706 | A1 | 4/2017 |
| EP | 0 266 149 | A2 | 5/1988 |
| EP | 0 659 895 | A2 | 6/1995 |
| EP | 1 040 890 | A1 | 10/2000 |
| EP | 3 048 287 | A1 | 7/2016 |
| JP | 52-11134 | A | 1/1977 |
| JP | 55-38988 | A | 3/1980 |
| JP | 57-92171 | A | 6/1982 |
| JP | 62-63663 | A | 3/1987 |
| JP | 62-130261 | A | 6/1987 |
| JP | 2012-41617 | A | 3/2012 |
| JP | 2013-64173 | A | 4/2013 |
| JP | 2013-534965 | A | 9/2013 |
| JP | 2015-59544 | A | 3/2015 |
| WO | WO-2015/004993 | A1 | 1/2015 |

OTHER PUBLICATIONS

Anonymous: "1", XP055970983, alleged to be retrieved from the internet on Oct. 13, 2022.
Anonymous: "Colorizer—Color Picker and Converter (RGB HSL HSB/HSV CMYK HEX LAB)," XP055970935, URL:https://colorizer.org/, alleged to be retrieved from the internet on Oct. 13, 2022.
Anonymous: "Light-Emitting Diode—Wikipedia", XP055947065, URL:https://en.wikipedia.org/w/index.php?title=Light? emitting_diode&oldid=574596129.
Anonymous: "Mentor 2671.8001 Leuchtkappe Transparent Passend fur (LEDs) LED 5 mm, Lampe 5 mm kaufen", XP055970930, URL:https://www.conrad.de/de/p/mentor-2671-8001-leuchtkappe?transparent-passend-fuer-leds-led-5-mm-lampe-5-mm-183434.html, alleged to be retrieved on Oct. 13, 2022.

(Continued)

*Primary Examiner* — Yi-Kai Wang
(74) *Attorney, Agent, or Firm* — Foley & Lardner LLP

(57) ABSTRACT

A sprayed coating for a sliding member of the present invention includes a ferrous alloy containing iron (Fe) as a major ingredient.

The sprayed coating for the sliding member containing 10 mass % or more and 20 mass % or less of chromium (Cr), and 0.1 mass % or more and 0.5 mass % or less of silicon (Si) and having the content rate of an oxide in the sprayed coating of 1 area % or less has corrosion resistance with improved seizure resistance.

15 Claims, No Drawings

(56) References Cited

OTHER PUBLICATIONS

ISO 11664-4:2008 Colorimetry—Part 4: CIE 1976 L*a*b* Colour Space, International Standard—Iso, Zuerich, CH, vol. 11664-4, No. 1st ed, (Nov. 1, 2008), XP009125830.

ISO 13468-2 Plastics—Determination of the Total luminous Transmittance of Transparent Materials—Part 2: Double-beam instrument, International Standard ISO/IEC, XX, XX, (May 1, 1999), XP009158647.

Anonymous, XP055970932, URL:https://asset.conrad.com/media 1 0/add/160267 /c1 /-/gl/ 000183434OS01 /datenblatt-183434-mentor-26718001-leuchtkappe?transparent-passend-fuer-leds-led-5-mm-lampe-5-mm.pdf, alleged to be retrieved from the internet on Oct. 13, 2022.

* cited by examiner

THERMAL SPRAYED COATING FOR SLIDING MEMBER, AND SLIDING DEVICE PROVIDED WITH THERMAL SPRAYED COATING FOR SLIDING MEMBER

TECHNICAL FIELD

The present invention relates to a thermal sprayed coating for a sliding member, and more specifically relates to a thermal sprayed coating for a sliding member, which contains chromium and has improved corrosion resistance.

BACKGROUND ART

Aluminum or aluminum alloy cylinder blocks for an internal combustion engine are provided with a cast iron liner on an inner circumferential surface of the cylinder bore, whereby functions, such as strength, wear resistance, and sliding characteristics, are improved.

However, the cast iron liner requires a thickness of a certain degree due to the production method of the cylinder block using the cast iron liner, and thus the weight of the entire cylinder block is increased. In addition, a gap is often generated on a surface joined to the cylinder block and thermal conductivity is often decreased.

In view of this, instead of using the cast iron liner, a thermal sprayed coating is formed on an inner circumferential surface of a cylinder bore, whereby weight of a cylinder block is reduced.

Patent Document 1 discloses a thermal spray wire to be used in thermal spraying on an inner surface of a cylinder bore.

A stainless steel-based thermal sprayed coating that contains chromium (Cr) is prevented from being corroded by low-quality fuel that contains a large amount of sulfur, but the thermal sprayed coating is reduced in peeling resistance due to lowering of bonding strength between thermal sprayed droplets that form the thermal sprayed coating. However, according to Patent Document 1, the decrease in bonding strength between thermal sprayed droplets can be prevented by adding a predetermined amount of manganese (Mn).

CITATION LIST

Patent Document

Patent Document 1: JP 2012-41617A

SUMMARY OF INVENTION

Technical Problem

A thermal sprayed coating disclosed in Patent Document 1 is formed by thermally spraying droplets with the use of compressed air, and oxidation of other metals, such as iron and chromium, can be reduced by sacrificial oxidation of manganese.

However, the thermal sprayed droplets have surfaces on which manganese oxides are formed, and oxides intervene in interfaces between the thermal sprayed droplets. Thus, the oxides break a metallic bond between the thermal sprayed droplets, and bonding strength between the thermal sprayed droplets is not sufficiently obtained, causing reduction in peeling resistance of the thermal sprayed coating.

Then, the surface of the thermal sprayed coating may partially come off, and a sliding surface may be contaminated with a foreign substance. In this state, a frictional force is increased, and an oil film is broken due to, for example, heat generation and lubrication failure. As a result, local deposition occurs, and finally seizure occurs.

The present invention has been made in view of these problems in the prior art, and an object thereof is to provide an iron-based thermal sprayed coating for a sliding member, which has corrosion resistance and improved seizure resistance.

Solution to Problem

The inventors of the present invention have made an intensive research to achieve the above object and have found the following findings. That is, limiting the content of an oxide in an iron-based thermal sprayed coating to 1 mass % or less can yield a uniform coating structure in which the entire coating is bonded by metallic bond. Thus, the present invention has been completed.

That is, a thermal sprayed coating for a sliding member of the present invention is composed of an iron-based alloy containing chromium (Cr) and silicon (Si).

Moreover, the content of chromium (Cr) is 10 mass % or more and 20 mass % or less, the content of silicon (Si) is 0.1 mass % or more and less than 0.5 mass %, the ratio of oxide in cross section of the thermal sprayed coating is 1 area % or less.

In addition, a sliding device of the present invention includes a sliding member and a mating member, and the sliding member and the mating member each have a coating on a base material and mutually slide.

The coating of the mating member is a hard carbon film, and the coating of the sliding member includes the thermal sprayed coating for a sliding member.

Advantageous Effects of Invention

In the present invention, the thermal sprayed coating is composed of the iron-based alloy that contains the predetermined amounts of chromium and silicon, and the ratio of an oxide in the thermal sprayed coating is limited to 1 area % or less. Thus, the present invention provides a thermal sprayed coating for a sliding member, which has improved seizure resistance and has corrosion resistance.

DESCRIPTION OF EMBODIMENTS

<Thermal Sprayed Coating for Sliding Member>

A thermal sprayed coating for a sliding member of the present invention will be described in detail.

The thermal sprayed coating for a sliding member (hereinafter simply referred to as a "thermal sprayed coating") is composed of an iron-based alloy containing iron (Fe) as a main component and containing chromium (Cr) and silicon (Si). The thermal sprayed coating contains 10 mass % or more and 20 mass % or less of chromium (Cr), 0.1 mass % or more and less than 0.5 mass % of silicon (Si) and the ratio of an oxide in cross section of the thermal sprayed coating is 1 area % or less. Note that the word "main component" in the present invention means a component that is contained in an amount of 50 mass % or more.

In general, a thermal sprayed coating is formed by melting a thermal spray wire at high temperature, and therefore, the thermal sprayed coating that is formed by oxidizing thermal sprayed droplets tends to contain the oxide in a large amount. However, the thermal sprayed coating of the present invention contains the oxide at a ratio of 1 area % or less, thereby having high peeling resistance and superior seizure resistance.

The ratio of the oxide in the thermal sprayed coating can be adjusted by controlling spraying atmosphere.

The oxide in the thermal sprayed coating does not originate from the composition of the thermal spray wire, but are generated mainly by oxidation of high-temperature thermal sprayed droplets, as described above.

Therefore, in order to prevent oxidation of thermal sprayed droplets that are flying, while non-oxidizing gas, such as nitrogen gas, is flowed as a shielding gas, thermal spraying is performed with the use of the non-oxidizing gas as a carrier gas. This suppresses generation of an oxide.

The thermal sprayed coating of the present invention is formed by thermal spraying with the use of non-oxidizing gas. Thus, an oxide film, which has a high melting point and easily solidifies, is hardly formed on a surface of a thermal sprayed droplet, when the thermal sprayed droplet is flying, and the thermal sprayed droplet sufficiently deforms at the time of landing.

As a result, a bonding area between the thermal sprayed droplets is increased. This forms a dense thermal sprayed coating that has a small number of voids due to strong bonding between the thermal sprayed droplets.

In addition, such a thermal sprayed coating has high coating strength and superior peeling resistance, because a metallic bond of the thermal sprayed coating is not broken by the oxide, and all the thermal sprayed droplets in the thermal sprayed coating are mutually bonded by a metallic bond and thereby form a uniform coating structure.

The ratio of the oxide in the thermal sprayed coating is measured from an optical microscopic image of a cross section of the thermal sprayed coating, as follows: identifying the oxide based on difference in brilliance, binarizing the cross-sectional image for quantification, and measuring the area % of the cross-section.

The thermal sprayed coating contains 10 mass % or more and 20 mass % or less of chromium (Cr).

If the content of chromium is less than 10 mass %, a passive film that is able to repair itself by using chromium, is not sufficiently formed. This causes reduction in corrosion resistance, whereby the thermal sprayed coating is easily corroded by, e.g., acids originating from NOx or a sulfur component of a fuel.

On the other hand, if the content of chromium exceeds 20 mass %, there is a risk that an affinity with a lubricating oil is reduced and protection by the lubricating oil may not be obtained, because a chromium passive film that is formed on a surface of the thermal sprayed coating contains oxide and hydroxide of chromium and has a hydroxyl group on the outermost surface of the solid phase. Moreover, a ferrite phase increases, whereby a martensite phase is hardly formed. This decreases coating hardness, resulting in reduction in seizure resistance. In addition, an austenite phase increases at the same time, which increases a coefficient of thermal expansion, causing a marked decrease in adhesiveness of the coating.

The thermal sprayed coating contains 0.1 mass % or more and 0.5 mass % or less of silicon (Si).

If the content of silicon is less than 0.1 mass %, tensile strength of the thermal sprayed coating is lowered, and if the content of silicon exceeds 0.5 mass %, seizure resistance is reduced.

The reasons for this are still not revealed, but the following may be one of the reasons. Silicon is also known as a ferrite stabilizing element and increases a ferrite ratio of the thermal sprayed coating, and silicon is hardly solid-solved in an iron-based alloy and is unevenly distributed on a surface of a thermal sprayed droplet. Due to this, in particular, in a case of thermal spraying with the use of nitrogen, e.g., as a gas for thermally spraying droplets, silicon nitride is easily formed. While silicon nitride has high strength and high toughness, a glass phase that is contained in silicon nitride is easily fractured by sliding, and microscopic fracture occurs from a grain boundary, causing easy coming off of silicon nitride particles.

The thermal sprayed coating preferably contains 0.6 mass % or less of manganese (Mn).

In consideration of manganese being an easily oxidized element, decreasing the content of manganese reduces the amount of oxides that are generated during flight of thermal sprayed droplets. Thus, an absolute amount of oxides in the thermal sprayed coating is reduced, and the entire thermal sprayed coating is bonded by a metallic bond, whereby the coating strength is improved.

The thermal sprayed coating preferably contains 3 mass % or more of manganese.

Although manganese is an easily oxidized element as described above, manganese in a non-oxidized state is solid-solved in the thermal sprayed coating to facilitate hardening and to transform the thermal sprayed coating structure to martensite. Thus, containing manganese in an amount of 3 mass % or more improves the coating strength.

The thermal sprayed coating can contain other elements, such as carbon (C), nickel (Ni), and molybdenum (Mo), as necessary.

The film thickness of the thermal sprayed coating is preferably 100 μm or more and 400 μm or less.

If the film thickness of the thermal sprayed coating is less than 100 μm, it is difficult to form recesses and projections having heights sufficient to enhance peeling resistance, and if the film thickness exceeds 400 μm, heat accumulates when thermal spraying is performed, whereby coating strength may be lowered, and peeling resistance may be reduced.

The iron-based alloy for composing the thermal sprayed coating has a thermal conductivity lower than that of an aluminum or aluminum alloy base material, which will be described later, and thus, a cooling efficiency decreases as the film thickness of the thermal sprayed coating increases.

In the present invention, it is possible to provide recesses and projections on an inner circumferential surface of a cylinder bore to improve peeling resistance of the thermal sprayed coating. In the case of providing recesses and projections, the film thickness of the thermal sprayed coating represents a thickness from a bottom of the recesses and projections.

The thermal sprayed coating preferably has a surface roughness (Ra) of 0.05 μm or less.

If the surface roughness exceeds 0.05 μm, the projection part is extended in a sliding direction by sliding and is deformed, and the extended part easily comes off. Thus, the sliding surface may be contaminated with a foreign substance, resulting in reduction in seizure resistance.

<Sliding Device>

The sliding device of the present invention includes a sliding member and a mating member that mutually slide.

The mating member has a hard carbon film on a base material, and the sliding member includes the thermal sprayed coating for a sliding member, on a base material.

The mating member, which slides with the sliding member having the thermal sprayed coating, has the hard carbon film as a sliding surface, whereby seizure resistance is improved. In general, it is known that a combination of the same types of materials reduces seizure resistance. The reason for this is that the combination of the same types of materials tends to occur adhesion due to their high mutual affinity and easily generates abrasive particles.

On the other hand, seizure resistance of a combination of different types of materials is influenced not only by mutual affinity of the different types of the materials, but also by a lot of factors, such as material factors, e.g., mechanical and chemical characteristics of materials, and dynamic factors. For this reason, it is very difficult to predict seizure resistance of the combination of different types of materials.

The sliding mating member has the coating of the hard carbon film (DLC), and therefore, the thermal sprayed coating for a sliding member exhibits greatly improved seizure resistance, compared with a case in which a sliding mating member has another coating, such as a chromium (Cr) coating or a chromium nitride (CrN) coating.

The hard carbon film preferably contains 95 mass % or more of carbon. The hard carbon film is an amorphous film in which carbon atoms are bonded by diamond bonding ($sp^3$ bonding) and graphite bonding ($sp^2$ bonding), and the hard carbon film has hardness, wear resistance, and chemical stability similar to those of diamond and has solid lubricating property and low friction coefficient similar to those of graphite. The content of carbon in an amount of 95 mass % or more improves hardness, wear resistance, and chemical stability.

The sliding device of the present invention can be suitably used for a piston and a cylinder block that are used in an internal combustion engine. For example, in the sliding device, a piston has the hard carbon film on a sliding surface, e.g. a piston ring, with a mating member, and a sliding member, such as a cylinder block, has the thermal sprayed coating on an inner surface of a bore that slides with the piston. With this configuration, superior seizure resistance is obtained.

Aluminum or aluminum alloy can be suitably used for the base material of each of the cylinder block and the piston, and these materials reduce weight of an internal combustion engine.

Examples

The present invention will be explained in detail with reference to Examples hereinafter, but the present invention is not limited to Examples described below.

An inner circumferential surface of a cylinder bore of an ADC12 alloy gasoline-engine cylinder block was grooved to have recesses and projections with heights of approximately 85 μm.

A thermal sprayed coating having a film thickness of 270 μm from the bottom of the recesses and projections was formed by arc spraying method with the use of a thermal spray wire having a composition shown in Table 1.

Thermal spraying was performed as follows. The cylinder block was preheated to 120° C., and a nozzle was inserted into the cylinder bore. Then, spraying was performed at 1200 L/min in the air atmosphere by using nitrogen gas for splashing thermally spraying droplets, while nitrogen gas was flowed at 500 L/min as a shielding gas.

The formed thermal sprayed coating was ground in such a manner that a flat part, excluding a pit specific for the thermal sprayed coating, was finished to have a surface roughness (Ra) of 0.05 μm or less.

<Evaluation>

The coating was evaluated by the following methods. The results of evaluation are shown in Table 1 together with the composition of the thermal sprayed coating.

(Composition of Thermal Sprayed Coating)

The composition of the thermal sprayed coating was quantitatively measured by dissolving a piece of the thermal sprayed coating obtained by scraping the cylinder block in nitric acid, followed by conducting an inductively coupled plasma analysis (IPC analysis).

In addition, the thermal spray wire was also subjected to IPC analysis in a similar manner, and it was confirmed that the thermal sprayed coating and the thermal spray wire had the same composition.

In the IPC analysis, the amounts of oxygen and nitrogen were detection limits or less due to their small dissolved amounts, and therefore, the composition ratio was obtained by excluding oxygen and nitrogen.

(Measurement of Ratio of Oxides) A cross section of the thermal sprayed coating was subjected to plane analysis using electron probe microanalyzer (SPMA), whereby oxides were identified.

Next, a ratio (area %) of oxides was calculated by using an optical microscope, in which a cross section of the thermal sprayed coating was magnified by 20 times. On the basis of difference in brilliance of oxides that were identified by using the electron microprobe analyzer, a ratio (area %) of oxides in an image was calculated by binarizing a cross-sectional image of an optical microscopic image.

(Seizure Resistance)

A piston having a hard carbon film on a surface of a piston ring, and a cylinder block having the thermal sprayed coating on the inner surface of the bore, were mutually slid under the following conditions. The hard carbon film contained 95 mass % or more of carbon. A seizure load was measured during the sliding, and seizure resistance was evaluated.

The sliding conditions were such that, while engine oil of viscosity grade 5W-30 was used, a load was increased every 5 minutes during reciprocation movement at a stroke of 20 mm and at a speed of 1000 rpm, and a load at the time of sudden rise of the load in the stroke direction was measured as a seizure load.

TABLE 1

| | Cr (mass %) | Si (mass %) | Mn (mass %) | C (mass %) | Ni (mass %) | Mo (mass %) | Fe (mass %) | Oxide Amount (area %) | Seizure Load (N) |
|---|---|---|---|---|---|---|---|---|---|
| Example 1 | 10 | 0.33 | 3.18 | 0.01 | — | — | Balance | 0.8 | 950 |
| Example 2 | 10 | 0.1 | 3.19 | 0.01 | — | — | Balance | 0.8 | 1150 |
| Example 3 | 18.12 | 0.48 | 8.67 | 0.1 | 12.04 | 0.83 | Balance | 0.9 | 1250 |
| Example 4 | 11.58 | 0.41 | 0.6 | 0.1 | — | — | Balance | 0.8 | 1000 |

TABLE 1-continued

| | Cr (mass %) | Si (mass %) | Mn (mass %) | C (mass %) | Ni (mass %) | Mo (mass %) | Fe (mass %) | Oxide Amount (area %) | Seizure Load (N) |
|---|---|---|---|---|---|---|---|---|---|
| Comparative Example 1 | 10 | 1.49 | 1.7 | 0.01 | — | — | Balance | 0.8 | 600 |
| Comparative Example 2 | 30.74 | 0.48 | 1.64 | 0.1 | 8.6 | — | Balance | 0.9 | 650 |
| Comparative Example 3 | 23.4 | 0.41 | 2.3 | 0.11 | 13.56 | 2.17 | Balance | 0.9 | 650 |
| Comparative Example 4 | 27.1 | 0.49 | 2.07 | 0.05 | 21.27 | — | Balance | 0.9 | 700 |
| Reference Example | — | 0.325 | 1.3 | 0.1 | — | — | Balance | 0.8 | 1050 |

Table 1 reveals that the thermal sprayed coatings of Examples that contained chromium in an amount of 10 to 20 mass %, silicon in an amount of 0.1 to 0.5 mass %, and oxides at a ratio of 1 area % or less had superior seizure resistance. Comparison between Example 3 and Comparative Example 3 reveals that seizure resistance was suddenly reduced in the case in which the content of chromium exceeds 20 mass %. This is because the thermal sprayed coatings of Comparative Examples 2 to 4 were not sufficiently protected by lubricating oil due to the large content of chromium. Thus, seizure resistance was reduced.

In addition, as for the thermal sprayed coating of Comparative Example 1, it is considered that seizure resistance was reduced, because the content of silicon was large, whereby foreign substances were generated on a sliding surface.

The invention claimed is:

1. A thermal sprayed coating for a sliding member, the thermal sprayed coating comprising:
- an iron-based alloy containing chromium (Cr) and silicon (Si), wherein:
- a content of iron (Fe) is 59.76 mass % or more,
- a content of chromium (Cr) is 10 mass % or more and 20 mass % or less,
- a content of silicon (Si) is 0.1 mass % or more and less than 0.5 mass %, and
- a ratio of an oxide in a cross section of the thermal sprayed coating is 1 area % or less.

2. A thermal sprayed coating for a sliding member, the thermal sprayed coating comprising:
- an iron-based alloy containing chromium (Cr) and silicon (Si), wherein:
- a content of iron (Fe) is 59.76 mass % or more,
- a content of chromium (Cr) is 10 mass % or more and 20 mass % or less,
- a content of silicon (Si) is 0.1 mass % or more and 0.5 mass % or less,
- a content of carbon (C) is less than 0.1 mass %, and
- a ratio of an oxide in a cross section of the thermal sprayed coating is 1 area % or less.

3. The thermal sprayed coating for a sliding member according to claim 1, containing manganese (Mn) at a ratio of 0.6 mass % or less.

4. The thermal sprayed coating for a sliding member according to claim 1, containing manganese (Mn) at a ratio of 3 mass % or more.

5. A sliding device comprising:
- a sliding member; and
- a mating member, wherein:
- each of the sliding member and the mating member comprises a base material, and a coating on the base material,
- the coating of the mating member is a hard carbon film, and
- the coating of the sliding member is the thermal sprayed coating for a sliding member according to claim 1.

6. The sliding device according to claim 5, wherein the hard carbon film contains 95 mass % or more of carbon (C).

7. The sliding device according to claim 5, wherein the base material of the sliding member and/or the mating member is aluminum or aluminum alloy.

8. The sliding device according to claim 5, wherein the sliding member is a piston, and the mating member is a cylinder block.

9. The thermal sprayed coating for a sliding member according to claim 2, containing manganese (Mn) at a ratio of 0.6 mass % or less.

10. The thermal sprayed coating for a sliding member according to claim 2, containing manganese (Mn) at a ratio of 3 mass % or more.

11. A sliding device comprising:
- a sliding member; and
- a mating member, wherein:
- each of the sliding member and the mating member comprises a base material, and a coating on the base material,
- the coating of the mating member is a hard carbon film, and
- the coating of the sliding member is the thermal sprayed coating for a sliding member according to claim 9.

12. The sliding device according to claim 11, wherein the hard carbon film contains 95 mass % or more of carbon (C).

13. The sliding device according to claim 11, wherein the base material of the sliding member and/or the mating member is aluminum or aluminum alloy.

14. The sliding device according to claim 11, wherein the sliding member is a piston, and the mating member is a cylinder block.

15. The thermal sprayed coating for a sliding member according to claim 1, wherein the iron-based alloy is an alloy containing iron as a main component.

* * * * *